US007594794B2

(12) United States Patent
Merry et al.

(10) Patent No.: US 7,594,794 B2
(45) Date of Patent: Sep. 29, 2009

(54) LEANED HIGH PRESSURE COMPRESSOR INLET GUIDE VANE

(75) Inventors: Brian D. Merry, Andover, CT (US); Om Parkash Sharma, South Windsor, CT (US); Gabriel L. Suciu, Glastonbury, CT (US); William E. Alford, Mesa, AZ (US)

(73) Assignee: United Technologies Corporation, Hartford, CT (US)

( * ) Notice: Subject to any disclaimer, the term of this patent is extended or adjusted under 35 U.S.C. 154(b) by 426 days.

(21) Appl. No.: 11/509,241

(22) Filed: Aug. 24, 2006

(65) Prior Publication Data

US 2008/0050220 A1 Feb. 28, 2008

(51) Int. Cl.
*F01D 9/00* (2006.01)

(52) U.S. Cl. ..... 415/161; 415/208.2

(58) Field of Classification Search ..... 415/161, 415/163, 164, 165, 208.2; 403/73, 75, 76, 403/165

See application file for complete search history.

(56) References Cited

U.S. PATENT DOCUMENTS

| | | | | | |
|---|---|---|---|---|---|
| 2,679,818 | A | * | 6/1954 | Herbert et al. | 114/230.15 |
| 2,689,680 | A | * | 9/1954 | Lovesey | 415/26 |
| 2,728,518 | A | * | 12/1955 | Wilde et al. | 415/1 |
| 2,942,291 | A | * | 6/1960 | Flint | 16/49 |
| 2,962,260 | A | * | 11/1960 | Foley | 416/189 |
| 4,193,738 | A | * | 3/1980 | Landis et al. | 415/115 |
| 4,972,671 | A | * | 11/1990 | Asselin et al. | 60/39.08 |

* cited by examiner

*Primary Examiner*—Ninh H Nguyen
(74) *Attorney, Agent, or Firm*—Bachman & LaPointe, P.C.

(57) ABSTRACT

A variable geometry inlet guide vane assembly that reduces stress placed on downstream compressor blades in gas turbine engines. The invention circumferential leans upstream guide vanes, pushing engine core air flow radially. This allows for aerodynamic stresses on the downstream blades to be reduced. The invention overcomes the difference in movement between a unison ring and a vane arm by providing a hinge in conjunction with a spherical bearing that couples to the unison ring.

22 Claims, 4 Drawing Sheets

LEANED HIGH PRESSURE COMPRESSOR INLET GUIDE VANE

BACKGROUND OF THE INVENTION

The invention relates generally to the field of variable geometry guide vanes for gas turbine engines. More specifically, the invention relates to variable geometry guide vane assemblies that reduce stress placed on downstream compressor blades.

A gas turbine engine compressor typically includes inlet guide vanes followed by a row, or stage of compressor rotor blades. A fan (military style) or high pressure compressor will only have one row of inlet guide vanes. There may be other rows of variable vanes, but they may differ in their principle of operation. During operation, air is sequentially compressed by the compressor stages. The compressed air is channeled to a combustor and mixed with fuel and ignited. The hot combustion gases generated power the engine.

Axial compressors rely on spinning blades that have airfoil sections similar to airplane wings. As with airplane wings, in some conditions the blades can stall or surge. If this occurs, the airflow around the stalled compressor can reverse direction violently. Many compressors are fitted with anti-stall systems such as bleed bands or variable geometry guide vanes to decrease the likelihood of surge.

To ensure compressor stability over a wide range of mass flow rates and operating speeds, variable guide vanes are employed. Guide vanes are usually cast structures having an airfoil and a platform. The aerodynamic vanes turn the airstreams through an angle to meet the blades of a following compressor stage and reduce the effective inlet area of the stage.

Variable guide vane assemblies use blades that can be individually rotated around their axis, as opposed to the power axis of the engine. For startup they are rotated to open, reducing compression, and then are rotated back into the airflow as operating conditions require. Closing the guide vanes progressively as compressor speed falls reduces the slope of the surge (or stall) line, improving the surge margin of the engine.

Vane movement is accomplished by coupling a corresponding vane arm to the outer ends of each vane and joining the vane arms to a common actuation or unison ring for providing uniform adjustment of the individual vanes. Each vane must be identically angled relative to the other vanes in the ring to maximize efficiency and prevent undesirable aerodynamic distortion from a misaligned vane.

Current variable geometry inlet guide vanes are positioned radially around the longitudinal engine axis. A typical variable inlet guide vane assembly is shown in FIG. 1. A problem experienced with current variable geometry guide vane designs is a stress that manifests itself at the root, or inner radial ends of the downstream compressor blades. The high stress experienced is due to unsteady air formed at their outer radial ends. The unsteady air pushes and pulls on the blades, stressing where they couple to an inner concentric engine structure.

Radial inlet guide vanes do not direct a uniform velocity of air across the downstream compressor blades as their geometry changes in response to engine demands. As a result, the compressor blades experience an unbalanced loading of air velocities with slower moving, separated air concentrated near the outer radial end regions.

What is desired is a variable geometry guide vane assembly that reduces unwanted compressor blade or fan blade stresses. The invention provides a solution to this problem.

SUMMARY OF THE INVENTION

The inventors have discovered that it would be desirable to have variable geometry guide vane assemblies that reduce stress placed on downstream compressor blades in gas turbine engines.

The invention circumferentially leans the guide vanes away from the pressure side at the outer radial diameter, effectively pushing the engine core air flow radially, towards the outer diameter and reducing airflow separations on the guide vane near the outer radial diameter. This allows for aerodynamic stresses on the downstream rotor blades to be reduced.

One aspect of the invention provides a variable geometry guide vane assembly for a gas turbine engine. Variable geometry guide vane assemblies according to this aspect comprise a plurality of vanes having a leading section and a trailing section pivotally mounted about an axis defined through a lower trunnion and an upper trunnion, the plurality of vanes extend between an inner concentric structure and an outer engine casing, where the lower trunnion is located at the inner concentric structure and the upper trunnion is located at the outer engine casing, and the axes for the plurality of vanes are not radial from the inner concentric structure.

Another aspect of the invention is where each vane axis is radially offset by an angular difference in a range of from greater than 0° to 30°.

Yet another aspect of the invention is a vane arm for a variable geometry guide vane assembly. Vane arms according to this aspect comprise a mounting end, a spherical bearing end having located therein a spherical-type bearing, and a hinge coupling the mounting end with the spherical bearing end.

Another aspect of the vane arm is the bearing end further comprises an end plane, a hinge plane, and a line of intersection wherein the line of intersection is defined where both planes meet.

The details of one or more embodiments of the invention are set forth in the accompanying drawings and the description below. Other features, objects, and advantages of the invention will be apparent from the description and drawings, and from the claims.

DETAILED DESCRIPTION

Embodiments of the invention will be described with reference to the accompanying drawing figures wherein like numbers represent like elements throughout. Further, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting, and coupling. Further, "connected" and "coupled" are not restricted to physical or mechanical connections or couplings.

Figure 1:
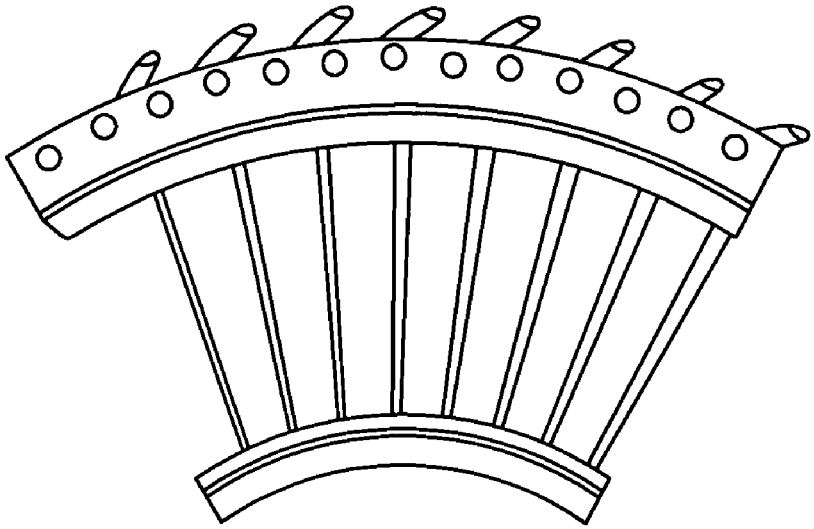
FIG. 1 is a partial front axial view of a variable geometry radial guide vane assembly.
Figure 2:
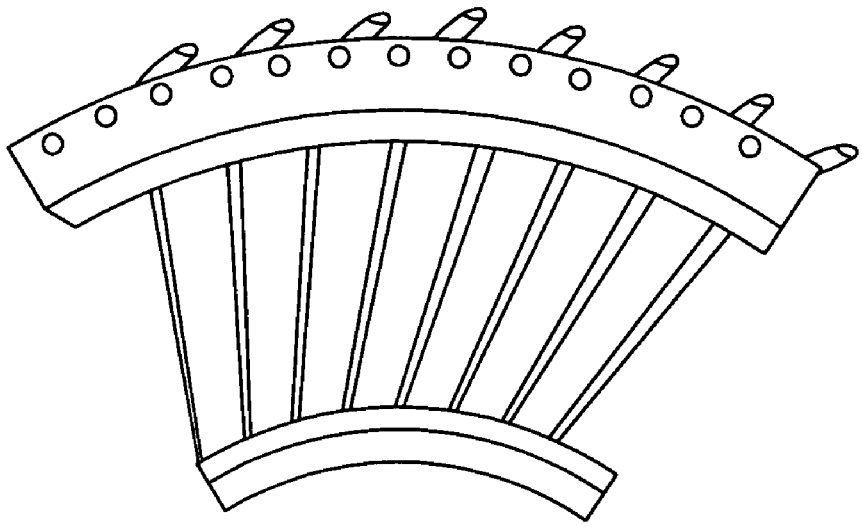
FIG. 2 is a partial front axial view of a variable geometry leaned guide vane assembly according to the invention.
Figure 3:
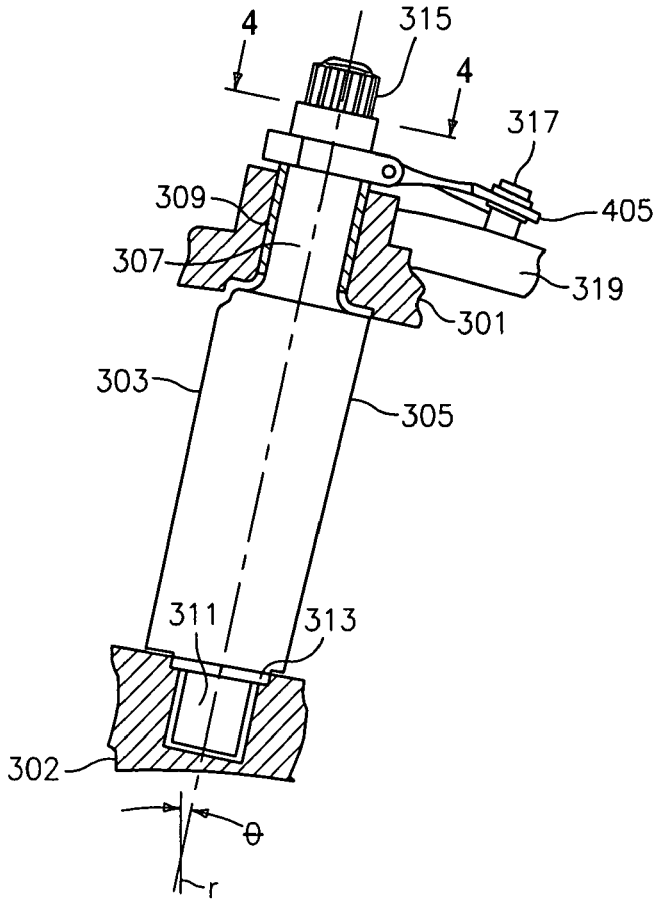
FIG. 3 is a partial front sectional, axial view of an exemplary variable geometry leaned guide vane mounted according to the invention.
Figure 6:
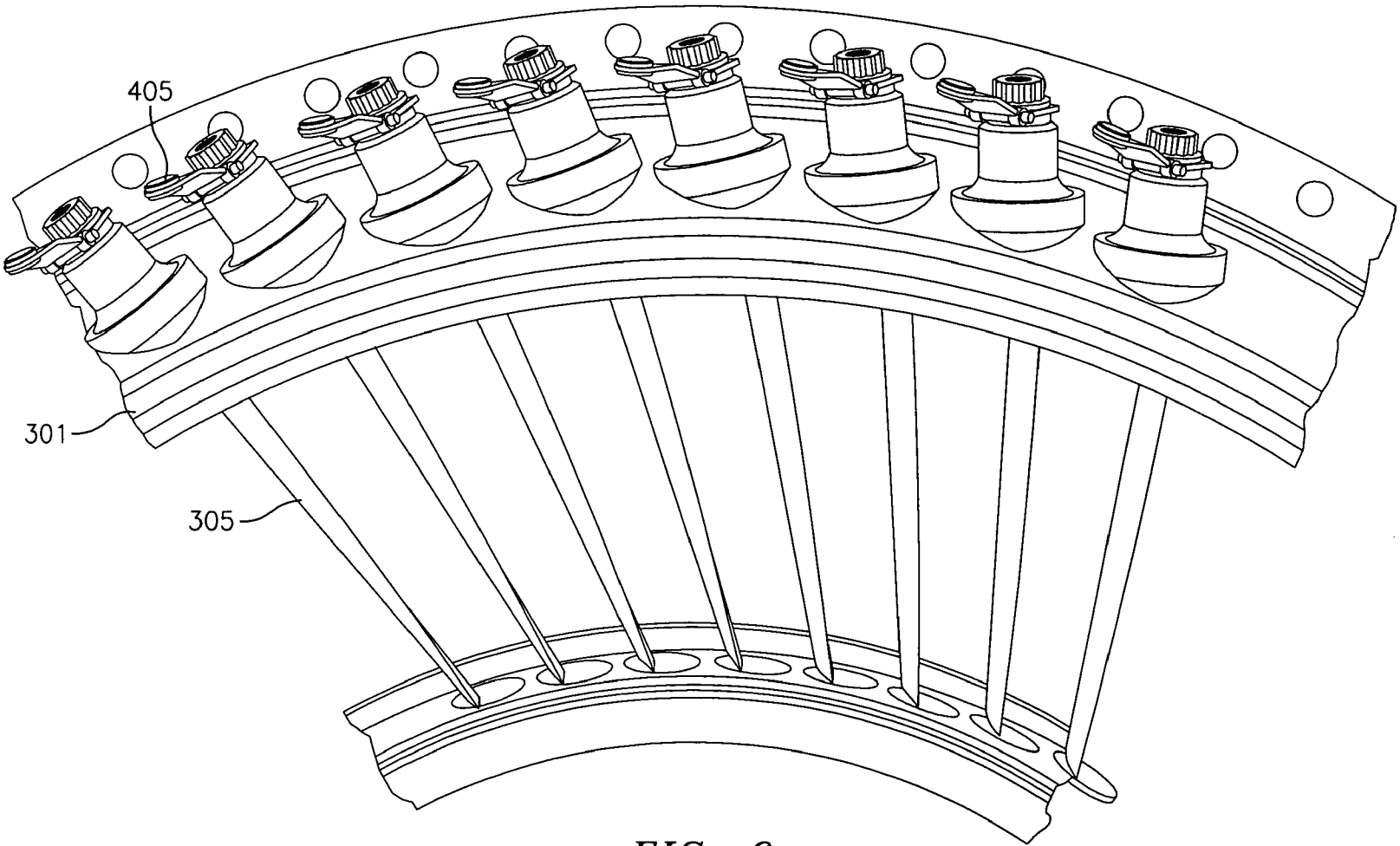
FIG. 6 is a partial perspective axial view of an exemplary variable geometry leaned guide vane assembly according to the invention.

The invention is a variable geometry leaned inlet guide vane assembly as shown in FIGS. 2, 3 and 6. The invention "leans" each guide vane away from the pressure side (direction of rotation) at the outer radial end. The lean for each vane may be set at one angular position. The vane axis is offset from a radius r by an angular difference θ in a range of $0°<\theta\leqq 30°$.

FIG. 2 shows a plurality of leaned guide vanes spaced apart equidistantly around the intake annulus of a gas turbine engine. Surrounding the intake annulus is an engine casing structure. The plurality of leaned guide vanes extends in a skewed, non-radial direction between an inner concentric structure and an outer engine casing.

The moveable vanes are mounted for selective rotation about an axis which passes through two trunnions. The angular rotation required of the movable vanes may be up to a maximum deflection of approximately 70°. Over the range of movement, the arc swept by the radially outer edges of the vanes has potential for interference with the annular shape of the inner surface of the engine casing. In order to accommodate this range of vane movement and to avoid gaps between the vane radially outer edge and the casing surface, these both conform to a part spherical surface configuration. Therefore a constant and minimal gap between the edge and surface may be maintained over the whole range of vane movement.

A vane actuating mechanism is provided on the radially outer side of the annular engine casing (not shown). This comprises a circumferentially movable unison ring to which the outer trunnion of each vane is connected by means of a vane arm.

Shown in FIG. 3 is a portion of an annular stator casing 301 of an exemplary axial compressor for a gas turbine engine to which is mounted a plurality of circumferentially spaced apart variable geometry leaned guide vanes 303. Each vane includes an airfoil 305 comprising leading and trailing edges, and high and low pressure sides.

Each vane 303 may be a cast structure and may be formed using any suitable casting technique known in the art. While the vanes 303 are preferably cast structures, they may also be machined if desired.

Each vane 303 further includes a radially outer trunnion 307 extending coaxially and integrally outwardly from the top of the airfoil 305 for pivotally mounting the airfoil 305 in a corresponding bushing 309 in the casing 301. The vane 303 also includes a radially inner trunnion 311 mounted in a sealing ring 313. Other variants of the invention may use other means to pivotally mount the airfoil 305 to the engine casing 301 and inner concentric structure 302.

Figure 4:
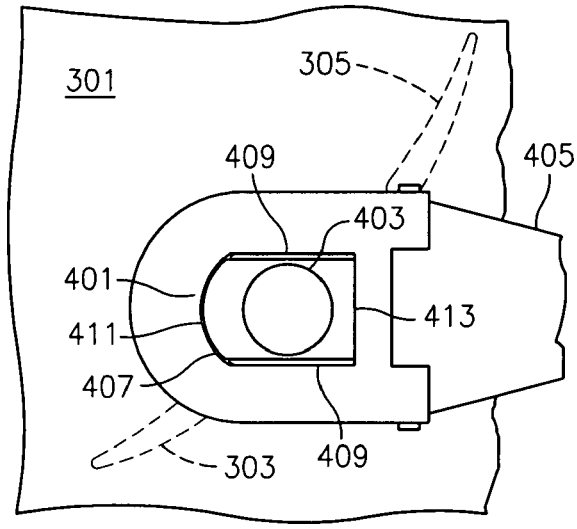
FIG. 4 is a partial top sectional view through an exemplary mounting portion of the leaned guide vane shown in FIG. 3 taken along line 4-4.
Figure 5:
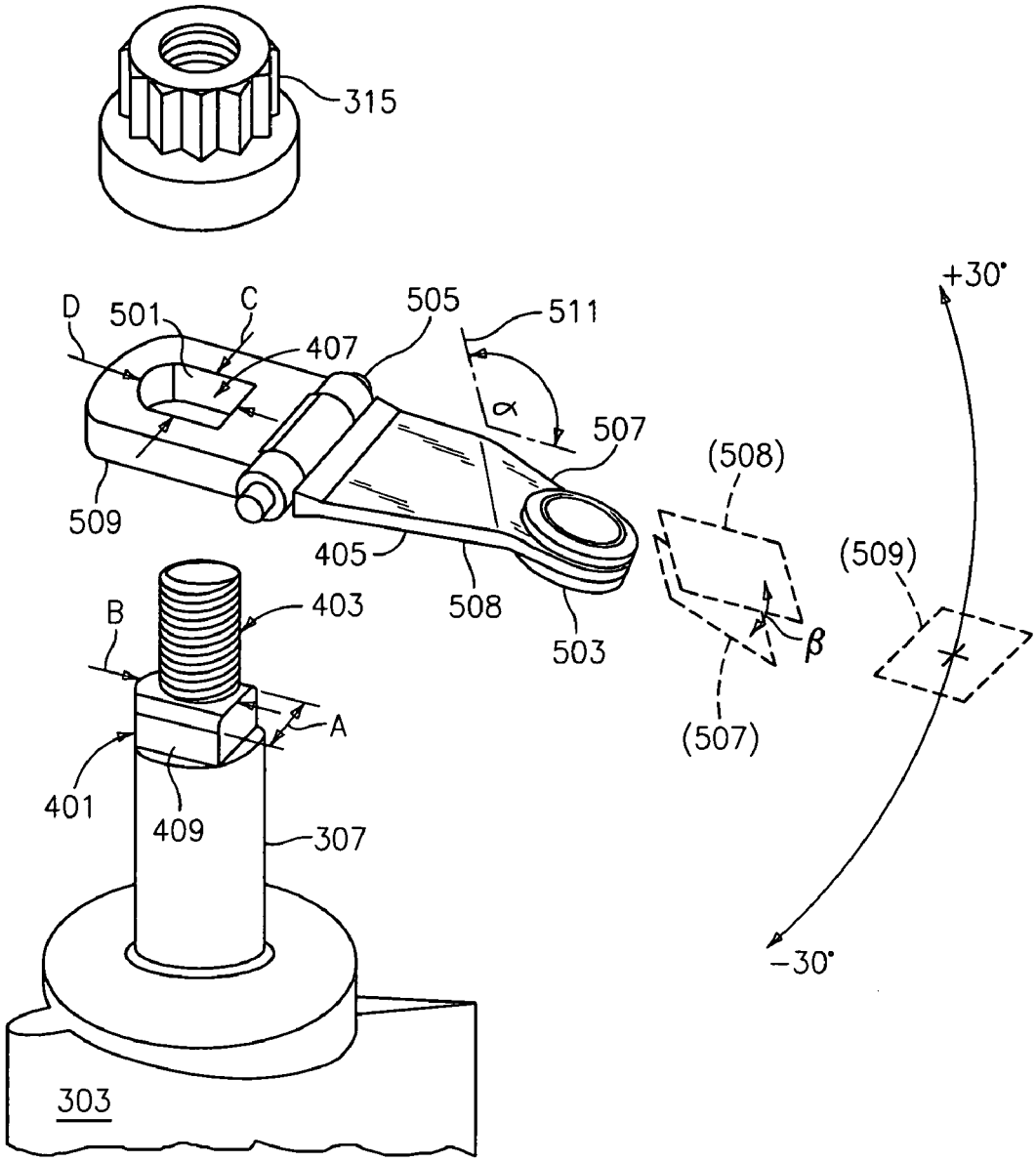
FIG. 5 is an exemplary exploded view of the variable geometry leaned guide vane shown in FIG. 3 with a vane arm.

In order to selectively rotate the airfoil 305 during operation, the airfoil 305 includes a keyed, D-shaped seat 401 as shown in FIG. 4 which extends radially outward from the trunnion 307 as shown in FIG. 5. A threaded stem 403 extends radially outward from the seat 401.

The threaded stem 403 is cylindrical with a substantially constant outer diameter, whereas the seat 401 is unidirectional in an exemplary D-shaped configuration below the stem 403 to provide a self alignment feature for mounting a vane arm 405 atop the airfoil 305 for selective rotation during operation. The vane arm 405 is secured to the airfoil 305 by a threaded retaining nut 315. Other variants of the invention may use other means such as keyed splines, crenulated surfaces in matching correspondence, or others to secure a vane arm 405 to a vane 303.

Each vane arm 405 has a spherical bearing (Heim-type bearing) 503 end which cooperates with a pin 317 located on an annular actuation, or unison ring 319 for simultaneously rotating in unison each of the airfoils 305 in an individual leaned guide vane assembly. Actuating a leaned vane is difficult since a non-articulating, planar vane arm 405 motion is not tangential with respect to the unison ring 319.

To compensate for the non-tangential travel the vane arm 405 experiences with respect to a unison ring 319 (radially offset $0°<\theta\leqq 30°$), the vane arm 405 includes a hinge 505. The hinge 505 divides the vane arm 405 into a spherical bearing 503 end and a mounting end 509. The hinge allows for rotational freedom in the range of about ±30° from a mounting end plane 509. For guide vanes having approximately a 14° lean, a hinge rotation of ±9° should be sufficient. For guide vanes having approximately a 30° lean, a hinge rotation of ±20° should be sufficient.

The spherical bearing 503 end comprises two planes, an end plane 507 and a hinge plane 508 that form a line of intersection 511. The intersection 511 is at an angle α with respect to a vane arm 405 longitude. The angle α may be placed on either side of the longitudinal reference depending on the embodiment desired.

The end plane 507 is angled at a dihedral from the hinge plane 508 at an angle of β. The angle β may be placed on either side of the hinge plane 508 depending on the embodiment desired. The range of motion offered by the hinge 505 in conjunction with the dihedral of the end 507 and hinge 508 planes allow for a non-binding freedom of movement as the unison ring 319 rotates to selectively pivot the airfoils 305.

The function of the end plane 507 and hinge plane 508 is to position the end plane 507 tangent to the unison ring 319 when the guide vanes 303 are at the midpoint of rotation. Most applications may have a in a range of $90°\leqq\alpha\leqq 150°$ and β in a range of $0°<\beta\leqq 45°$.

In a preferred embodiment, the mounting hole 407 is generally a D-shaped configuration in matching correspondence with the seat 401 around which it is seated. The seat 401 preferably includes a pair of opposite, parallel side flats 409 which define a width A of the seat 401. The seat 401 also has an arcuate front 411 and a flat back 413 which define a length B of the seat 401. The seat 401 may be narrower in width A than in length B. The mounting hole 407 includes a pair of opposite, parallel side walls 501 spaced apart at a width C. The mounting hole 407 also includes a generally arcuate front and a flat back which are spaced apart over a length D. The hole width C may be less than the hole length D to correspond with the configuration of the seat 401 and allow for precise alignment. As described above, other configurations for coupling a vane arm 405 to a guide vane 303 are possible.

The invention reduces stress placed on compressor blades which use upstream guide vanes, and fan blades which use upstream guide vanes in turbofan engines. The invention leans the guide vanes circumferentially, pushing engine core air flow towards the downstream blades. This allows the stresses on the downstream blades to be significantly reduced.

The invention overcomes the difference in articulation between a unison ring 319 and vane arm 405. The hinged vane arm 405 of the invention couples with a unison ring 319 using a spherical joint 503. The hinge 505 dividing the vane arm 405 permits the end plane 507 to follow the path of the unison ring 319. This arrangement allows a leaned guide vane assembly to be actuated by a conventional unison ring.

One or more embodiments of the present invention have been described. Nevertheless, it will be understood that various modifications may be made without departing from the spirit and scope of the invention. Accordingly, other embodiments are within the scope of the following claims.

What is claimed is:

1. A variable geometry guide vane assembly for a gas turbine engine comprising:

a plurality of vanes having a leading section and a trailing section pivotally mounted about an axis defined through a lower trunnion and an upper trunnion; and a plurality of vane arms each coupled with associated one of the vanes, wherein:

said plurality of vanes extend between an inner concentric structure and an outer engine casing, wherein said lower trunnion is located at said inner concentric structure and said upper trunnion is located at said outer engine casing;

said axes for said plurality of vanes are not radial from said inner concentric structure; and each said vane arm comprises:

a mounting end;

a spherical bearing end having located therein a spherical-type bearing; and a hinge coupling said mounting end with said spherical bearing end.

2. The vane assembly according to claim 1 wherein each said vane axis is radially offset by an angular difference in a range of from greater than 0° to 30°.

3. The vane assembly according to claim 2 wherein each said vane axis angular difference is the same value.

4. The vane assembly according to claim 1 wherein said hinge allows for a ±30° range of motion between said mounting and spherical bearing ends.

5. The vane assembly according to claim 4 wherein said mounting end further comprises means to couple with said upper trunnion.

6. The vane assembly according to claim 5 wherein said vane arm bearing end further comprises:

an end plane;

a hinge plane; and a line of intersection defined where said end plane and said hinge plane meet.

7. The vane assembly according to claim 6 wherein said line of intersection is in a range of from 90° to 150° off of a vane arm longitude defined through said coupling means and said spherical bearing.

8. The vane assembly according to claim 7 wherein said line of intersection forms an angle between said end plane and said hinge plane in a range of from greater than 0° to 45°.

9. The vane assembly according to claim 8 wherein said spherical bearing end couples with a unison ring for selectively rotating said plurality of vanes.

10. The vane assembly according to claim 9 wherein said hinge angular range in conjunction with said end and hinge planes allow for freedom of movement as said unison ring rotates to selectively pivot said plurality of vanes.

11. A vane arm and unison ring assembly comprising:

said unison ring;

a circumferentially spaced plurality of said vane arms, each having:

a mounting end;

a spherical bearing end having located therein a spherical-type bearing and coupled with the unison ring; and a hinge coupling said mounting end with said spherical bearing end.

12. The assembly according to claim 11 wherein said hinge allows for a ±30° range of motion between said mounting and spherical bearing ends.

13. The assembly according to claim 12 wherein said mounting end further comprises a keyed aperture sized in matching correspondence with an upper trunnion of a vane to couple with.

14. The assembly according to claim 13 wherein said vane arm bearing end further comprises:

an end plane;

a hinge plane; and a line of intersection defined where said end plane and said hinge plane meet.

15. The assembly according to claim 14 wherein said line of intersection is in a range of from 90° to 150° off of a vane arm longitude defined through said keyed aperture and said spherical bearing.

16. The assembly according to claim 15 wherein said line of intersection forms an angle between said end plane and said hinge plane in a range of from greater than 0° to 45°.

17. The assembly according to claim 11 wherein said hinge angular range in conjunction with said end and hinge planes allow for freedom of movement as said unison ring rotates.

18. A vane arm comprising:

a mounting end having a keyed aperture, said keyed aperture sized in matching correspondence with an upper trunnion of a vane to couple with;

a spherical bearing end having located therein a spherical-type bearing; and a hinge coupling said mounting end with said spherical bearing end, said hinge allowing for a ±30° range of motion between said mounting and spherical bearing ends.

19. The vane arm according to claim 18 wherein said vane arm bearing end farther comprises:

an end plane;

a hinge plane; and a line of intersection defined where said end plane and said hinge plane meet.

20. The vane arm according to claim 19 wherein said line of intersection is in a range of from 90° to 150° off of a vane arm longitude defined through said keyed aperture and said spherical bearing.

21. The vane arm according to claim 20 wherein said line of intersection forms an angle between said end plane and said hinge plane in a range of from greater than 0° to 45°.

22. A variable geometry guide vane assembly for a gas turbine engine comprising: a plurality of vanes having a leading section and a trailing section pivotally mounted about an axis defined through a lower trunnion and an upper trunnion; said plurality of vanes extend between an inner concentric structure and an outer engine casing, wherein said lower trunnion is located at said inner concentric structure and said upper trunnion is located at said outer engine casing; and said axes for said plurality of vanes circumferentially lean off-radial from said inner concentric structure; further wherein the circumferential lean leans each guide vane away from the pressure side at the outer radial end of such vane.

* * * * *

UNITED STATES PATENT AND TRADEMARK OFFICE

CERTIFICATE OF CORRECTION

PATENT NO. : 7,594,794 B2
APPLICATION NO. : 11/509241
DATED : September 29, 2009
INVENTOR(S) : Merry et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 462 days.

Signed and Sealed this

Twenty-eighth Day of September, 2010

David J. Kappos

David J. Kappos
*Director of the United States Patent and Trademark Office*